US005445475A

United States Patent [19]

Fujino

[11] Patent Number: 5,445,475

[45] Date of Patent: Aug. 29, 1995

[54] FLOATING UP GUIDE DEVICE

[76] Inventor: Tadanobu Fujino, 824-4 Mutsukawa 1-Chome Minami-ku, Yokohama-shi, Japan

[21] Appl. No.: 147,318

[22] Filed: Nov. 5, 1993

[30] Foreign Application Priority Data

Jul. 6, 1993 [JP] Japan ..... 5-191973

[51] Int. Cl.[6] ..... B63C 11/02

[52] U.S. Cl. ..... 405/186; 405/185

[58] Field of Search ..... 405/185, 186; 441/80, 441/88, 89

[56] References Cited

U.S. PATENT DOCUMENTS 3,670,509 6/1972 Walters ..... 405/186

5,049,864 9/1991 Barshinger ..... 405/186 X

*Primary Examiner*—David H. Corbin

*Attorney, Agent, or Firm*—Cushman Darby & Cushman

[57] ABSTRACT

A floating up guide device has an external wall portion forming a floating up guide device body and a hollow interior portion defined within the external wall. The external wall portion forming the floating up guide device body being formed of a hard material which does not vary the volume of the hollow interior portion. The hollow interior portion being sealingly enclosed by the external wall portion. A balancing member variable of weight being detachably attached on one end of the external wall portion.

5 Claims, 3 Drawing Sheets

FLOATING UP GUIDE DEVICE

BACKGROUND OF THE INVENTION

1. Field of the Invention

The present invention relates to an underwater floating up guide device. More specifically, the invention relates to an improvement for a device for guiding a diver in floating up at a constant speed when the diver floats up in the water.

2. Description of the Related Art

As is well known, many people enjoy diving in the ocean or in fresh-water bodies. When the diver floats up to the surface of a body of water, he is required to float up at a constant, predetermined speed. This is because the diver has to moderately exhaust nitrogen gas accumulated in the body while under water in order to avoid suffering from "the bends".

The floating up speed has been conventionally set at approximately 10~18 m per minute in order to effectively exhaust nitrogen gas from the body of the diver. Therefore, a study has been made for means for enabling the diver to float up at the constant speed of approximately 10~18 m per minute.

One of such means is a floating up guide device. The floating guide device is a device designed to float up from underwater toward the water surface at a constant speed. The device is used in such a manner that the diver releases the device in the water. Then, the floating up guide device floats up toward the water surface at a constant speed. The diver then floats up while targeting the floating up guide device so as to maintain constant separation from the device. Namely, the diver floats up and is guided by the floating up guide device. By setting the floating up speed of the floating up guide device at approximately 10~18 m, the diver may float up and effectively exhaust the nitrogen gas accumulated in the body.

Here, discussion will be given for the conventional floating up device. The conventional floating up guide device is disclosed in Japanese Unexamined Patent Publication No. 58-150598. The disclosed device includes a safety valve designed to automatically discharge the content in a balloon when a difference of pressures between inside and outside of the balloon reaches a predetermined value.

In further detail, the floating up guide device includes a hollow space defined in an external wall portion. The external wall portion forms the balloon. When a gas is blown into the interior of the balloon, the hollow space is formed by expansion. In an opening portion of the balloon, a blowing inlet and, as well, a discharge outlet are defined in communication with the hollow space. A safety valve is mounted in the discharge outlet. The safety valve is controlled by a spring provided in series with the safety valve. The spring force of the spring determines a discharge amount of the gas in the balloon.

Discussing the manner of use of the above-mentioned floating guide device, at first, a gas is blown into the balloon through the blowing inlet. This gas is blown into the interior space of the balloon by exhaust gas of the diver or by means of a gas generator, such as a gas bomb and so forth. When a certain amount of gas is blown into the balloon, the floating up guide device is released. Soon after beginning to float upwards, the gas expands inside the balloon due to a decrease of the water pressure. Thus, a predetermined amount of gas is discharged in response to expansion of the gas. By this, the gas pressure in the balloon is controlled to maintain the volume of the gas constant. Therefore, a constant floating up speed can be attained irrespective of the initially blown gas volume. Then, the diver floats up while targeting the floating up guide device and maintaining a constant separation therebetween.

With the above-mentioned prior art, the following defects or drawbacks can be encountered. Namely, at first, the balloon is formed of a relatively soft material to have an elasticity. Due to the elasticity, the balloon may be expanded due to the pressure difference between inside and outside the balloon. If the balloon is expanded by the gas pressure therein to cause variation of its volume, the floating up guide device cannot float up at the constant speed. Therefore, in order to attain the constant floating up speed, an additional mechanism (concretely, the safety valve) must be provided. Secondly, since the discharge amount of the gas in the balloon is determined by the strength of the spring provided in series with the safety valve, the floating up speed of the floating up guide device is variable depending upon the strength of the spring. In other words, the floating up speed of the floating up guide device must be set by the strength of the spring. However, installation and removal of the spring is not so easy, so that one set on the water should be carried into the water for use. Therefore, when the diver wants to set the floating up speed of the floating up guide device within the preferred range of 10~18 m, adjustment cannot be easily performed or in the water. Thirdly, before starting use, the conventional device requires blowing of the gas into the balloon. The operation to blow in the gas into the balloon is troublesome and cumbersome work. In addition, this operation should be done for every dive, which make use of such device impractical.

SUMMARY OF THE INVENTION

Therefore, it is an object of the present invention to provide a floating up guide device for guiding floating up to the water surface at a constant speed without requiring any additional mechanism for adjusting the floating up speed so as to maintain a constant speed.

Another speed object of the present invention is to provide a floating up guide device which allows for easy adjustment of the floating up speed.

A further object of the present invention is to provide a floating up guide device to which preparatory work is easily done.

In order to accomplish the above-mentioned object, a floating up guide device according to the present invention, has an external wall portion forming a floating up guide device body and a hollow interior portion defined within the external wall. The external wall portion forming the floating up guide device body is formed of a hard material which does not vary the volume of the hollow interior portion. The hollow interior portion is sealingly enclosed by the external wall portion. A balancing member variable of weight is detachably attached on one end of the external wall portion.

The above-mentioned balancing member may comprise a plurality of ring members detachably connected in series to form a chain-like configuration, the overall weight of the balancing member being variable depending the number of the ring members connected.

According to another aspect, the floating up guide device body has another end, to which a balancing member for stopping the floating up guide device in the water is detachably attached, the balancing member for stopping being variable of in weight.

The balancing member for stopping may comprise a plurality of ring members detachably connected in series to form a chain-like configuration, the overall weight of the balancing member for stopping being variable depending upon the number of ring members connected.

According to a further aspect of the invention, the floating up Guide device body is formed of a transparent material, the hollow interior portion having a waist portion for restricted path area and enclosing therein a sand for sandglass so that the floating up guide device body serves as a sandglass by reversing up side down in the water.

Discussion will be given for the above-mentioned construction of the floating up guide device of the present invention. At first, a diver stores the floating up guide device in a pocket of a wet suite or so forth to carry into the water. After finishing underwater activities, the floating up guide device is taken out of the pocket.

The floating speed of the overall floating up guide device related to the weight of the balancing member is preliminarily set on the ground. Namely, at a predetermined value of the weight of the balancing member, the floating up speed of the overall floating up guide device is preliminarily set when the predetermined weight of the balancing member is attached. By this, when the weight of the balancing member is A, for example, the floating up speed of the overall floating up control device becomes the speed corresponding to the weight A of the attached balancing member. Similarly, when the weight of the balancing member is B, for example, the floating up speed of the overall floating up control device becomes the speed corresponding to the weight B of the attached balancing member.

Next, after setting the floating up speed of the floating up guide device, the diver releases the floating up guide device.

The, the diver floats up while targeting the floating up guide device and maintaining a constant spacing therebetween.

BRIEF DESCRIPTION OF THE DRAWINGS

The present invention will be understood more fully from the detailed description given hereinafter and from the accompanying drawings of the preferred embodiment of the invention, which however, are not intended to limit the scope of the present invention, but are for explanation and understanding only.

In the drawings.

DESCRIPTION OF THE PREFERRED EMBODIMENT

In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessary obscure the present invention.

Figure 1:
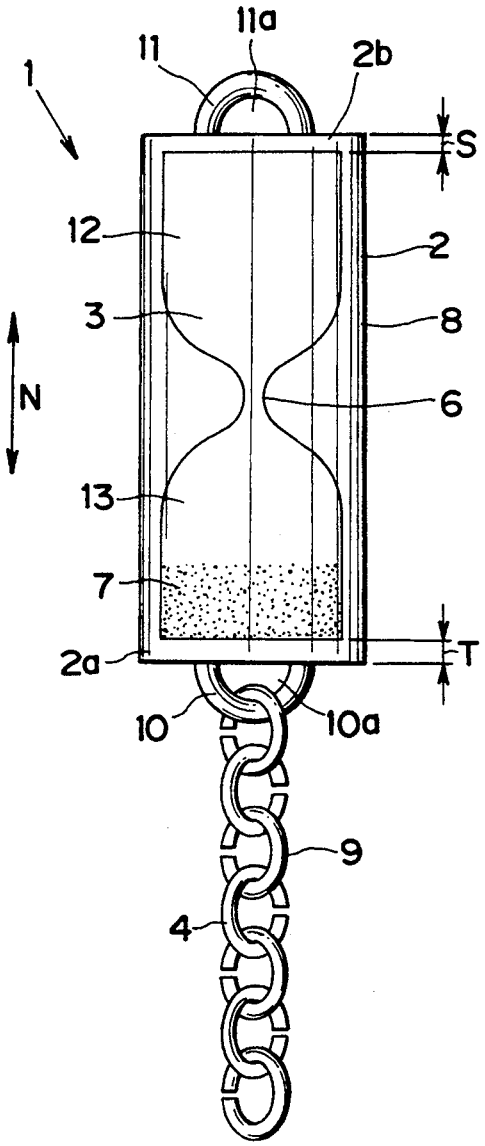
FIG. 1 is a front elevation of the first embodiment of a floating up guide device according to the present invention.
Figure 2:
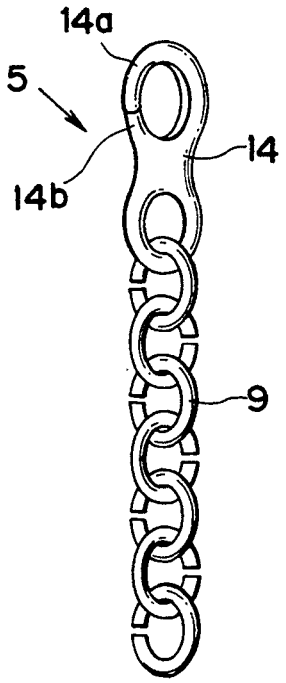
FIG. 2 is a front elevation illustration showing a balancing member, for stopping in the water, to be employed in the first embodiment of the floating up guide device of the invention.
Figure 3:
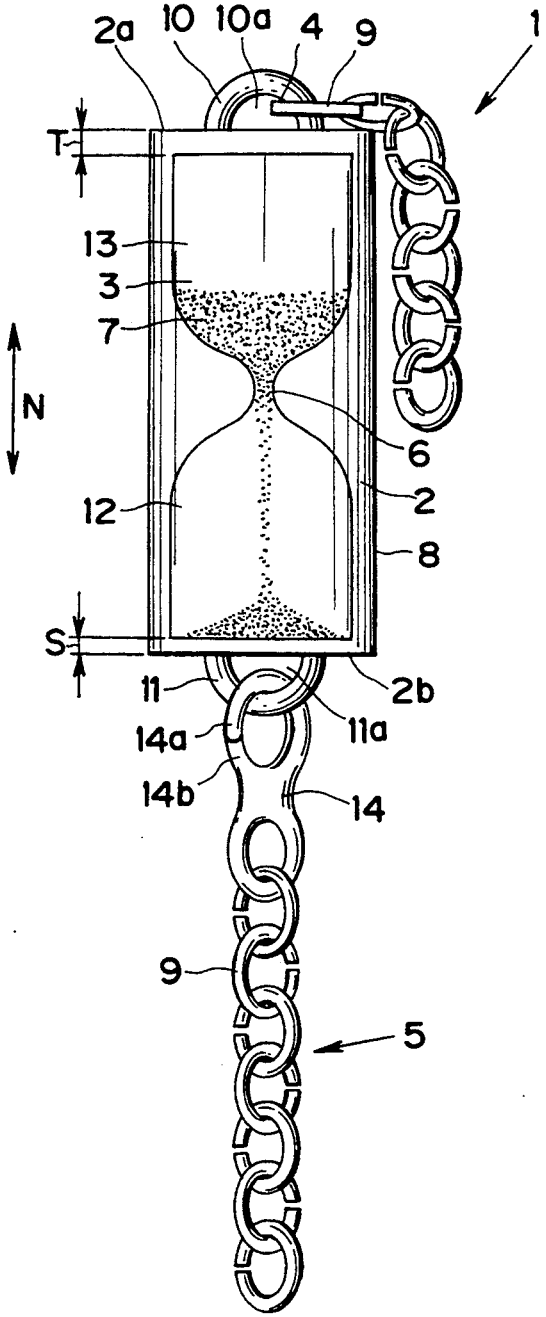
FIG. 3 is a front elevation illustration in a condition where the balancing member for stopping in the water is mounted on the first embodiment of the floating up guide device of the invention.

The preferred embodiments of a floating up guide device according to the invention will be discussed with reference to the accompanying drawings. FIGS. 1 to 3 show the first embodiment of a floating up guide device 1 according to the present invention. The floating up guide device 1 comprises a floating up guide device body 8 and a balancing member 4 detachably connected to the floating up guide device body 8.

The floating up guide device body 8 defines a hollow interior space 3 enclosed by an external wall portion 2. The external wall portion 2 is formed of a hard material which does not permit variation of the volume of the hollow interior space 3 and which is transparent to make the hollow interior space visible. A preferred material for the floating up guide device body is a styrol, acryl or the like. Here, not causing volume variation means that little volume variation is caused at a water pressure at a diving depth to be reached by a sport scuba diving.

At one end **2*a* in the vertical direction N of the external wall portion 2, a balance member connecting portion 10 is formed. The balance member connecting portion 10 defines a through opening 10*a*. At the other end 2*b* in the vertical direction S of the external wall portion 2, a balance member connecting portion 11, to which a balance member 5 for stopping in the water is connected, is provided. The balance member connecting portion 11 defines a through opening 11*a***.

Next, the hollow interior portion 3 is divided into two spaces by a waist portion 6 internally projecting from the internal surface of the external wall portion with maintaining a narrowed communication path. Hereinafter, the hollow space in the vicinity of the end **2*b* of the external wall portion 2 will be referred to as a first hollow space 12 and the hollow space in the vicinity of the end 2*a* will be referred to as a second hollow space 13. These first and second hollow spaces 12 and 13 are sealingly enclosed by the external wall portion 2**.

In the hollow interior space 3, a sand 7 for a sandglass is contained. From the orientation of the floating up guide device body 1 where the first hollow portion 12 is positioned at upper side and the second hollow portion 13 is positioned at the lower side in the vertical direction N, and the sandglass sand 7 is placed within the second hollow portion 13, the floating up guide device body 1 is reversed to place the second hollow portion 13 at the upper side and the first hollow portion 12 at the lower side in the vertical direction N. Then, the sandglass sand 7 in the second hollow portion 13 falls into the first hollow portion 12 through the waist portion 6. By preliminarily determining the time for transferring the sand 7 from the second hollow portion 13 to the first hollow portion 12, the floating up guide device 8 serves as a sandglass. Furthermore, the thickness T of one end 2*a* of the external wall portion 2 is greater than the thickness S of the other end 2*b* so that the gravity center of the floating up guide device is offset toward one end 2*a*. Therefore, under the water, the floating up guide device body 8 is normally oriented to place the other end 2*b* at the upper side in the water. The balancing member 4 includes a plurality of ring members 9. A plurality of ring members 9 are connected in series to form a chain-like configuration. By adjusting the number of the ring members 9 connected, the weight of the balancing member 4 can be varied. The ring member 9 positioned at one end of the series is detachably connected to the balancing member connecting portion 10 of the floating up guide device body 8 through the through opening 10*a*.

The balancing member 4 is adapted to adjust the floating up speed of the floating up guide device body 8. Namely, by varying the number of the ring members 9 in the series, the weight of the balancing member 4 is differentiated to vary the buoyancy of the floating up guide device body 8, to which the balancing member 4 is connected, and whereby the floating up speed of the floating up guide device body 8 is varied.

Setting of floating speed of the overall floating up guide device 1, namely the floating up guide device body 8 connected thereto the balancing member 4 is preliminarily determined depending upon the weight of the balancing member 4. Namely, when the number of the ring members 9 in the series of the balancing member 4 is five, the floating up speed of the floating up guide device 1 with the five ring members 9 is set at approximately 18 m per minutes. Also, when the number of the ring members 9 in the series is eight, the floating up speed of the floating up guide device 1 with the eight ring members 9 is set at approximately 15 m per minutes.

Next, discussion will be given concerning means for stopping the floating up guide device 1 in the water. Namely, the means is a balancing member 5 for stopping to be connected to the floating up guide device body 8. The balancing member 5 includes the ring members 9 connected in series and a connecting head portion 14 at one end for connecting to the floating up guide device body 8.

The connecting head portion 14 has a hook portion 14*a* and a claw portion 14*b* adapted to resiliently contact with the hook portion 14*a*. The hook portion 14*a* is engaged to the balance member connecting portion 11 at the other end 2*b* of the external wall portion 2 via the through opening 11*a* formed therethrough. Thus, the balancing member 5 for stopping in the water is connected to the floating up guide device body 8. On the other hand, when the balancing member 5 for stopping in the water is removed from the floating up guide device body 8, the claw portion 14*b* of the connecting head portion 14 is depressed to release from the hook portion 14*a* to form clearance therebetween. The balance head connecting portion 11 may pass through the clearance thus formed and removed away from the connecting head portion 14.

The ring members 9 connected in series to the connecting head portion 14 are disconnectable from each other and from the connecting head portion 14. Therefore, by adjusting number of the ring members 9 connected in series, the overall weight of the balancing member 5 can be varied.

The balancing member 5 is thus adjusted, the weight and volume so that weight of the balancing member 5 in the water may cancel the buoyancy of the floating up guide device body 8 by adjusting the number of ring members 9 in the series.

When the balancing member 5 for stopping in the water is connected to the floating up guide device body 8, the floating up guide device 1 and the balancing device 5 for stopping in the water are balanced to each other in the buoyancy and weight. Therefore, the floating up guide device 1 is stopped in the water.

In practice, in order to stop the floating up guide device 1 in the water, setting for the balancing member 5 is preliminarily determined in relation to the balancing member 4, Namely, assuming that the number of the ring members 9 in the balancing member 4 is five, the overall floating up guide device 1 have a specific buoyancy where the balancing member 4 with five ring members 9 is serving to provide negative buoyancy. In view of the specific buoyancy of the overall floating up guide device 1, number of the ring members 9 to be employed in the balancing member 5 is determined so that the negative buoyancy of the balancing member 5 may cancel the specific buoyancy, e.g. five.

Furthermore, when the balancing member 5 for stopping in the water is connected to the balance member connecting portion 11, the floating up guide device body 8 is reversed in orientation. This is because that by connecting the balancing member 5 for stopping in the water, the balance of the buoyancy is reversed. When the floating up guide device body 8 is reversed, the sand of the sandglass in the hollow space portion 3 starts to fall into the first hollow space 12 from the second hollow space 13. Thus, the floating guide device body 8 serves as the sandglass.

Next, various way of use of the floating up guide device constructed as set forth above will be discussed. At first, the diver will carry the floating up guide device 1 and the balancing member 5 for stopping in the water in the pocket of a wet or diving suit. Then, after finishing all desired activities, upon floating up to the surface, the diver takes the floating up guide device 1 from the pocket.

Then, the floating up guide device 1 is released to float up toward the surface of the water. The diver also floats up with adjusting the floating up speed so that the diver's floating up speed may be consistent with the floating up speed of the floating guide device 1. At this time, the floating up speed of the floating up guide device 1 is selected in a range of 10~18 m for safety in floating up.

When the diver and the floating up guide device 1 reach a predetermined depth (e.g. approximately 5 m), the diver stops floating up and takes out the balancing member 5 to connect to the floating up guide device 1. By this, the floating up guide device body 8 is reversed to activate the sandglass. At the same time, the floating up guide device 1 is stopped in the water. Then, the diver also stops in the water (for approximately 3 minute) with reference to the floating up guide device 1 serving as the sandglass. This is an activity contributing for exhausting of nitrogen gas accumulated in the diver's body more certainly and safely.

After temporary stop in the water, the balancing member 5 is removed from the floating up guide device 1. Then, the floating up guide device 1 restarts floating up. Then, the diver floats up while targeting the floating upon guide device 1 to the surface of the water.

With the foregoing floating up method, the nitrogen gas accumulated in the diver's body during diving can be moderately exhausted. In addition, by temporary stop at the predetermined depth for a predetermined period, the nitrogen gas can be more certainly exhausted.

Figure 4:
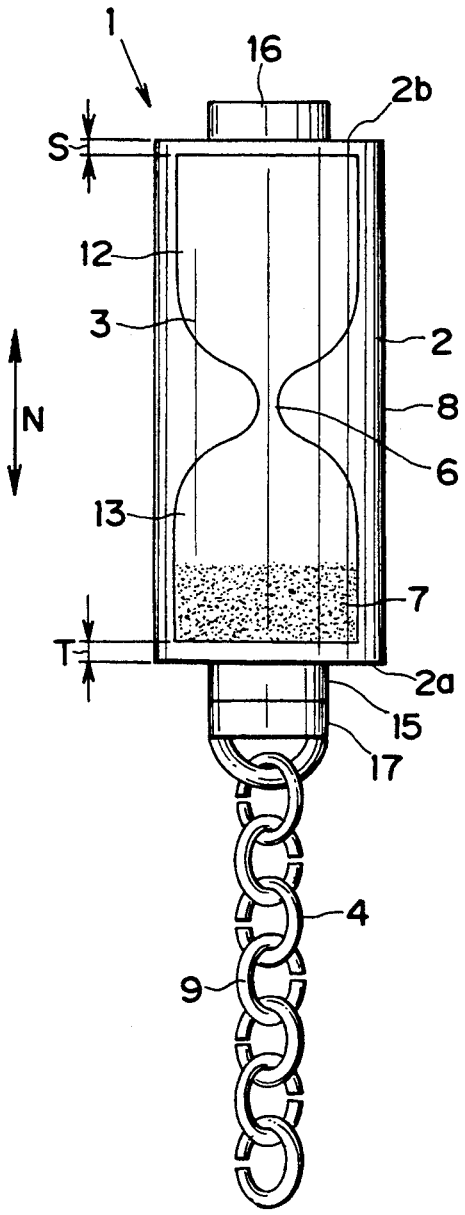
FIG. 4 is a front elevation of a modification of the first embodiment of the balancing member of the first embodiment of the floating up guide device of the preceding drawings.
Figure 5:
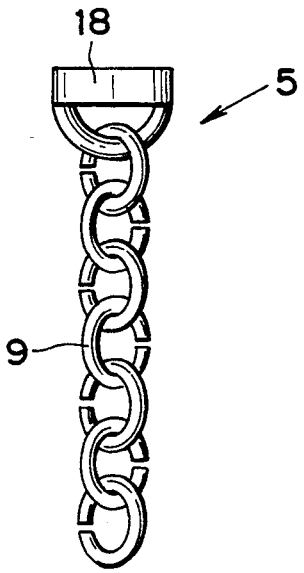
FIG. 5 is a front elevation of the balancing element for stopping in the water to be employed in the modification of the first embodiment of the floating up guide device of the invention.

FIGS. 4 and 5 show a modification of the first embodiment of the floating up guide device according to the invention. Namely, in the shown embodiments, a magnet 15 is provided at one end *2a* of the external wall portion 2 and a magnet 16 is provided at the other end *2b*.

On the other hand, the balancing member 4 is formed by connecting the ring members 9 in series and has a magnet 17 at one end.

The balancing member 4 is detachably attached to the floating up guide device 1 by engaging the magnet 17 to the magnet 15 on the external wall portion 2.

Also, the balancing member 5 for stopping in the water is provided with a magnetic head portion 18 replaces the connecting head portion 14 in the former embodiment.

The magnetic head portion 18 is detachably engaged with the magnet 16 on the end *2b* of the external wall portion 2 so that the balancing member 5 for stopping in the water can be detachably attached to the floating up guide device body 8.

It should be noted that as a means for detachably connecting the balancing member 4 to the floating up guide device body 8, various other means, such as means employing a thread, can be used. Also, as means for detachably connecting the balancing member for stopping in the water to the floating up guide device body 8, various other means, such as means employing a thread, can be used. Also, the balancing members 4 and 5 are not specified to the shown construction, in which the ring members connected in series are employed, but can be of any suitable construction as long as adjustment of the weight is permitted.

As set forth above, the floating up guide device according to the present invention can float up substantially at a constant speed by setting the floating up speed of the floating up guide device 1 by initially setting the weight of the balancing member 4. Also, by employing the balancing member 5 for stopping in the water, the rising motion of the floating up guide device can be temporarily stopped in the water.

As set forth above, since the floating up guide device according to the present invention has the external wall portion formed of a hard material which does not permit variation of the volume of the hollow interior portion, and since the hollow interior space is a sealed and enclosed space, the floating up guide device body will never expand even at lowered water pressure. Therefore, the predetermined volume can be constantly maintained to attain uniform or constant floating up speed at any underwater depth. Furthermore, the shown construction of the floating up guide device does not require any means for maintaining the floating up speed constant. Also, only by adjusting the weight of the balancing member, the buoyancy of the overall floating up guide device can be adjusted. Therefore, the floating up speed of the floating up guide device can be easily set. Furthermore, the preparatory work in the water for preparing the floating up guide device from releasing is relatively simple, it does not require a substantial period. Namely, by preliminarily setting the weight of the balancing member, the diver is only required to simply release the floating up guide device.

Also, by means of the balancing member for stopping in the water, the floating up guide device can be temporarily stopped in the water. By this, the diver can temporarily stop in the water at a predetermined depth together with the floating up guide device to assure exhausting of the nitrogen gas accumulated in the body.

Also, since the external wall portion is formed of a transparent material and the floating up guide device body is provided with the sandglass function, in conjunction with stopping the floating up guide device in the water by means of the balancing guide for stopping, the period of time can be measured so that required period for staying at the predetermined depth can be easily seen.

Although the invention has been illustrated and described with respect to exemplary embodiments thereof, it should be understood by those skilled in the art that various changes, omissions and additions may be made therein and thereto, without departing from the spirit and scope of the present invention. Therefore, the present invention should not be understood as limited to the specific embodiment set out above but to include all possible embodiments and their equivalents which can falls within the of the appended claims.

What is claimed is:

1. A floating up guide device comprising:

an external wall portion forming a floating up guide device body having a first end and a second end and a hollow interior defined within said external wall;

wherein said external wall portion forming said floating up guide device body is formed of a inflexible material which does not vary the volume of said hollow interior portion;

wherein said hollow interior portion is sealed and enclosed by said external wall portion; and wherein a balancing member variable in weight is detachably attached on said first end of said external wall portion.

2. A floating up guide device as set forth in claim 1, wherein said balancing member comprises a plurality of ring members detachably connected in series to form a chain-like configuration, the overall weight of said balancing member being variable depending upon a number of said ring members connected together.

3. A floating up guide device as set forth in claim 1, wherein said second end of said floating up guide device has a second balancing member, for stopping the floating up guide device in the water, detachably attached thereto, said second balancing member for stopping variation of weight.

4. A floating up guide device as set forth in claim 3, wherein said second balancing member comprises a plurality of ring members detachably connected in series to form a chain-like configuration, the overall weight of said balancing member for stopping weight variation depending upon a number of said ring members connected.

5. A floating up guide device as set forth in claim 1, wherein said floating up guide device body is formed of a transparent material;

wherein said hollow interior portion has a waist portion for restricted path area and enclosing therein a sand for a sandglass so that said floating up guide device body serves as a sandglass by turning upside down in the water.

* * * * *